United States Patent [19]

Horvath

[11] Patent Number: 4,540,177

[45] Date of Patent: Sep. 10, 1985

[54] PUZZLE CUBE

[76] Inventor: Tibor Horvath, 1877 E. 27 St., Brooklyn, N.Y. 11229

[21] Appl. No.: 381,183

[22] Filed: May 24, 1982

Related U.S. Application Data

[63] Continuation-in-part of Ser. No. 305,479, Sep. 25, 1981, Pat. No. 4,405,131.

[51] Int. Cl.[3] ..... A63F 9/08

[52] U.S. Cl. ..... 273/153 S

[58] Field of Search ..... 273/153 S, 155, 156, 273/157 R

[56] References Cited

U.S. PATENT DOCUMENTS

| | | | |
|---|---|---|---|
| 1,006,878 | 10/1911 | Rankin | 273/157 R |
| 1,144,799 | 6/1915 | Tiernan | 273/153 S |
| 3,946,514 | 3/1976 | Joslyn | 273/153 S X |
| 4,421,311 | 12/1983 | Sebesteny | 273/153 S |
| 4,478,418 | 10/1984 | Sherman | 273/153 S |

FOREIGN PATENT DOCUMENTS

| | | | |
|---|---|---|---|
| 8108498.6[U] | 9/1981 | Fed. Rep. of Germany | 273/153 S |
| 170062 | 12/1977 | Hungary | 273/153 S |
| 55-3956 | 1/1980 | Japan | 273/153 S |

OTHER PUBLICATIONS

"The Simple Solutions to Cubic Puzzles" by James G. Nourse, published by Bantam Books, Inc., N.Y., Nov. 1981, pp. 50, 51.

*Primary Examiner*—Anton O. Oechsle
*Attorney, Agent, or Firm*—Howard C. Miskin

[57] ABSTRACT

A puzzle device includes a hub with six orthogonally related square sockets, six mutually spaced circular retainers having inner and outer faces lying in spherical planes spaced from and concentric with the hub and coupled to respective sockets by square shanks, seven triangular slide members slidably underlying and bridging adjacent retainers and having outwardly projecting triangular shanks, an interlocking member having three ribs each of which is anchored in one of the recesses in the retainer, and three tongues each of which releasably engages recesses formed in the slide member peripheries and face members connected to the triangular shanks and having outside faces forming a regular three dimensional figure when the slide, retainer and interlocking member are in interlocked condition. The face members may have many different shapes, for example square, triangular, flattened spherical quadrants and form respectively different configurations. The slide member supported face members are rotatable in groups of four about selected orthogonally related axes. In an alternative construction the face members deliniate a sphere with orthogonally related circular openings rotatably engaging groups of four outer center face members. Edge outer face members slidably engage the center members and corner outer face members slidably engage the other outer face members. The exposed faces of the face members may carry orientation determative indicia.

4 Claims, 36 Drawing Figures

PUZZLE CUBE

BACKGROUND OF THE INVENTION

The present invention relates generally to improvements in puzzle devices and it relates particularly to an improved puzzle device of the type in which groups of elements are rotatable about selected orthogonally related axes to move individual elements into a predetermined relationship.

A puzzle device which is highly popular includes a main cube which is divided into groups of minor cubes of nine cubes disposed three by three along each face of the main cube. Each of the groups of cubes being independently rotated about an axis perpendicular to the plane of the group, the axes of the groups being othorgonally related. The faces of the minor cubes are variously colored and it is the general object of the puzzle to successively rotate the groups about their respective axes from a random arrangement of the minor cubes to a condition wherein the minor cubes achieve a predetermined arrangement, for example with the faces of the minor cubes in a group being of the same color.

However, the device of the above nature heretofore available possesses numerous drawbacks and disadvantages. The solution of the puzzle is difficult and very highly time consuming. Furthermore, the structure of the aforesaid puzzle device is complicated allowing for no variations on the general modus operandi of the device and only limited and superficial variations in its configuration and appearance. Thus the conventional Rubic cube leaves much to be desired in its application, construction and operation.

SUMMARY OF THE INVENTION

It is a principal object of the present invention to provide a simplified but improved puzzle device.

Another object of the present invention is to provide an improved puzzle device of the type wherein elements of an assembled unit are movable in three dimensions into different spacial relationships of the elements.

A further object of the present invention is to provide an improved puzzle device of the above nature characterized by its ruggedness and ease of assembly and operation, low cost, attractive appearance and great versitility and adaptability.

The above and other objects of the present invention will become apparent from a reading of the following description taken in conjunction with the accompanying drawings which illustrate preferred embodiments there of.

A puzzle device in accordance with the present invention comprises the assembly of a central core member, a plurality of mutually spaced retainer members connected to, spaced from and surrounding the core member and having inside faces lying in a spherical plane concentric with the core member, a plurality of peripherally spaced slide members underlying the retainer members and slidable in circular paths about orthogonally related axes intersecting at the center of said spherical plane and a face member connected to each of the slide members and disposed outwardly of the slide and retainer members.

In the preferred form of the improved puzzle device the core member has six outwardly directed sockets of square transverse cross section arranged in pairs along orthogonally related axes and six retainer members are provided, each being circular and of spherical convex concave configuration with four equally spaced notches formed in its periphery and having formed therewith a central square cross section shank engaging a respective socket. Seven slide members are provided, each being triangular and of spherical convex concave configuration and underlying the retainer members and having a positioning recess in each edge and an outward) directed shank of equalateral triangular cross section. A single locking member is diposed at the level of and relative to the retainer members and includes three radially projecting flexible tongues each of which releasably engages a slide member notch or recess to releasably lock the slide members in predetermined relative positions, and a triangular shank projects outwardly from the locking member. The face members each include mutually perpendicular outside faces and an inwardly diagonally directed socket engaging a correpsonding triangular shank. The eight face members, in predetermined positions of the slide members constitute the corners of cubes with the free edges of each face member being contiguous with those of adjacent face members. Any two groups or layer of four face members perpendicular to a common axis are rotatable relative to each other about such axis from one locked position for one or more 90° increments to another locked position. The face members may carry orientation determative indcia and be of shapes other than that of the corners of a cube, and shapes other than that of a cube achieved in the adjusted predetermined positions of the face member carrying members. The above device may be of spherical shape and movably support outer face members.

The improved puzzle device is rugged, easy to assemble and operate and of great versitility and adaptablility.

DESCRIPTION OF THE PREFERRED EMBODIMENTS

Figure 1:
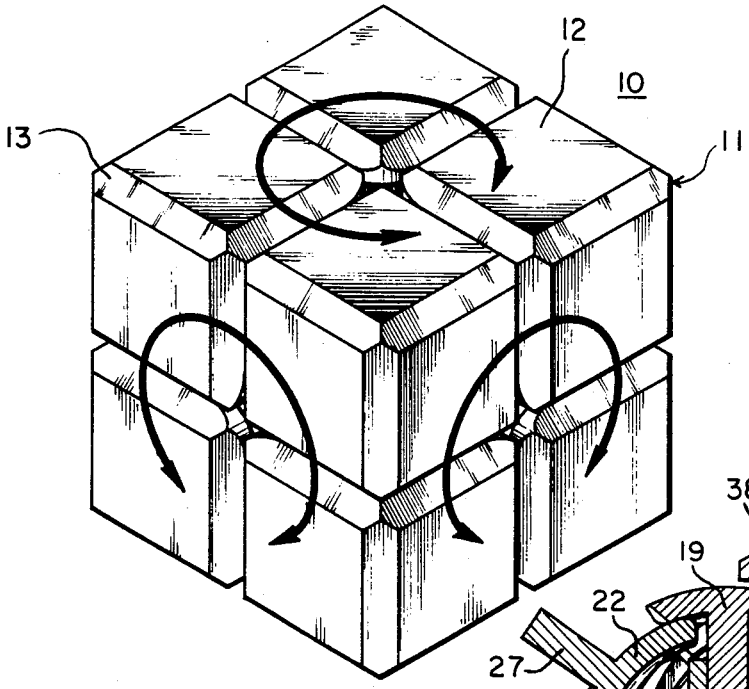
FIG. 1 is a perspective view of a puzzle device embodying the present invention.
Figure 2A:
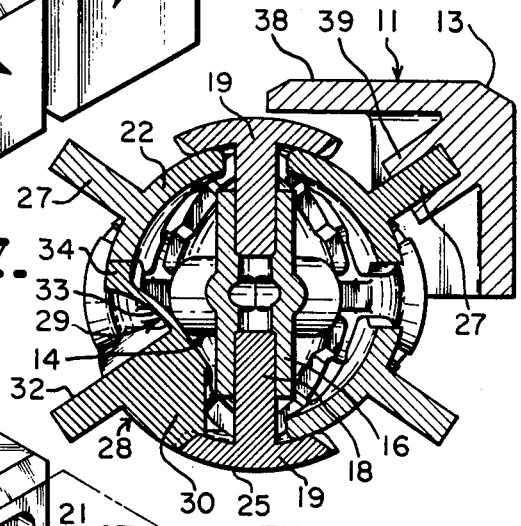
FIG. 2A is a sectional view taken along line 2A—2A in FIG. 2.
Figure 2:
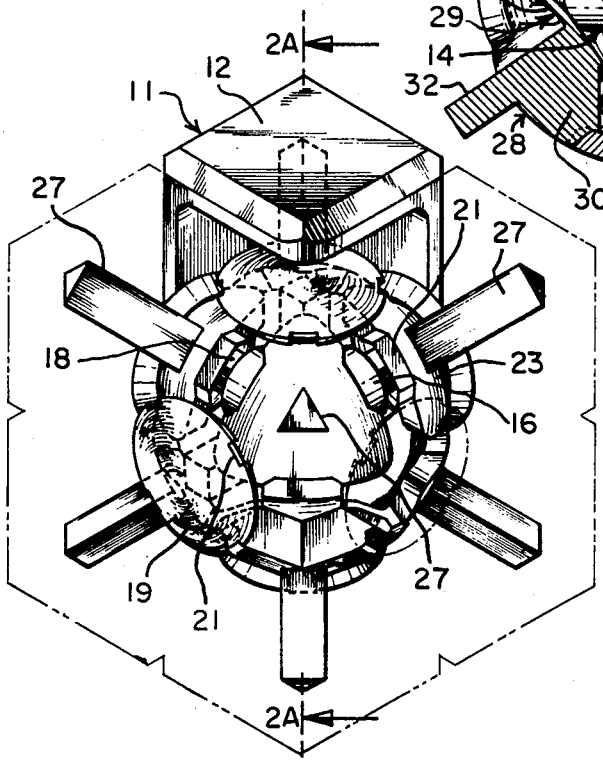
FIG. 2 is a perspective view thereof, partially broken away to show the internal mechanism.
Figure 3:
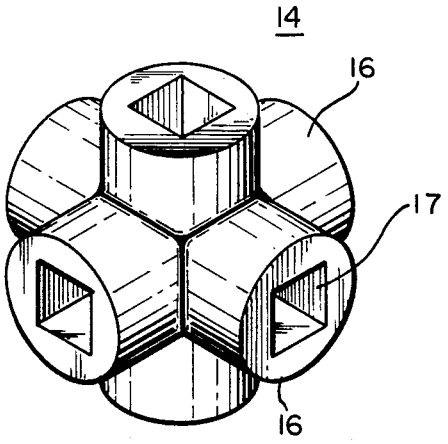
FIG. 3 is a perspective view of the core member of the device.
Figure 4:
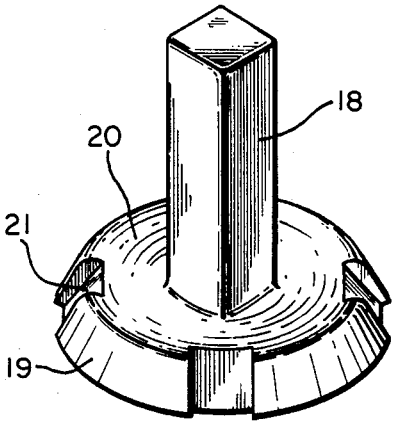
FIG. 4 is a bottom perspective view of one of the retainer members.
Figure 5:
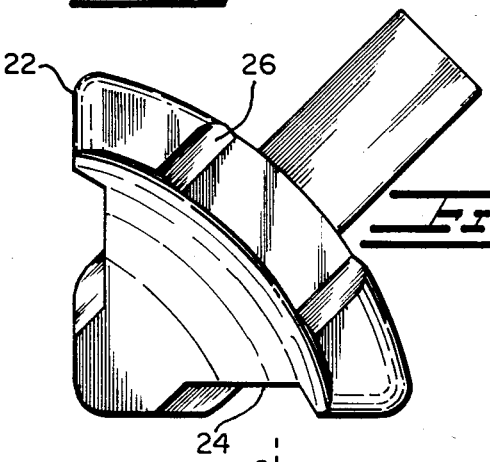
FIG. 5 is a bottom perspective view of one of the slide members.
Figure 6:
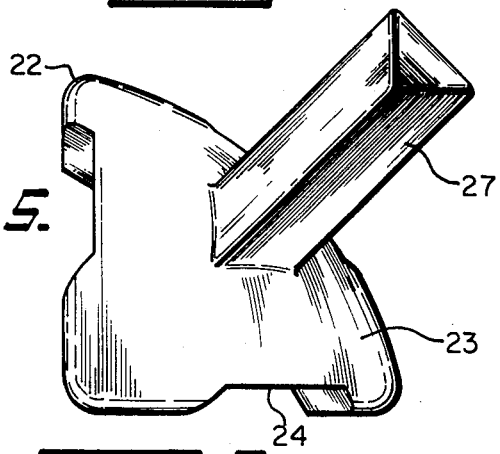
FIG. 6 is a top perspective view thereof.
Figure 7:
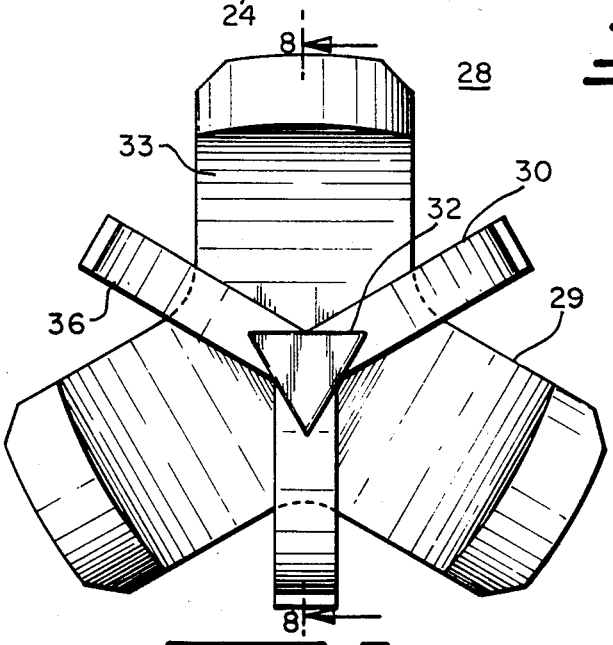
FIG. 7 is a top plan view of the locking member.
Figure 8:
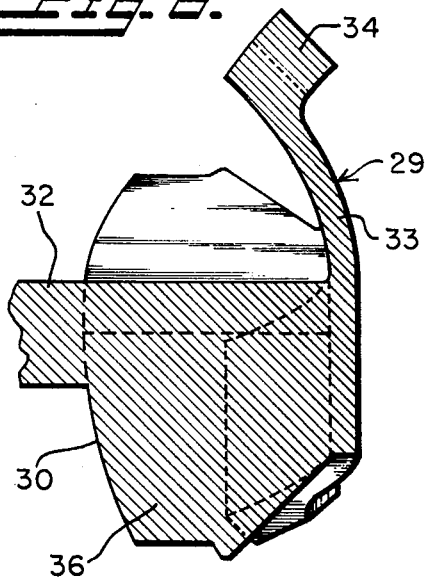
FIG. 8 is a sectional view taken along line 8—8 in FIG. 7.
Figure 9:
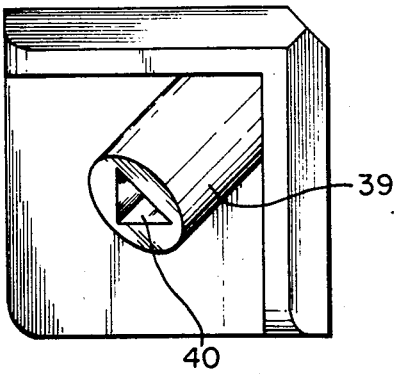
FIG. 9 is a rear elevational view of one of the face members.

Referring now to the drawings, particularly FIGS. 1 to 10 thereof which illustrate a preferred embodiment of the present invention the reference numeral 10 generally designates the improved puzzle device which, in the shown embodiment, is in its normal condition in the shape of a cube formed of eight face members 11 which are located at each corner of the cube and having three mutually perpendicular or orthogonally related outside faces 12 and bevelled edges 13. The free edges of each face member 11 is contiguous to those of adjacent face members 11 and each of the outside faces 12 may be colored or marked as desired so that the solution or solutions of the puzzle may be readily identified by the relationships of the faces 12.

The puzzle device 10 includes a central core member or hub 14 in the form of a six armed three dimensional spider having six orthogonally related pairs of coaxially related integrally formed cylindrical socket members 16 having similarly oriented axial bores or sockets 17 or square transverse cross section.

Engaging each of the sockets 17 and projecting axially redially outwardly therefrom is a respective square shank 18 formed integrally with and projecting centrally and perpendicularly from a retainer member defining circular head 19. The head 19 has a spherical concave inside face 20 and a spherical convex outside face 25, the faces 20 and 25 of the six retainer members 19 lying in respective inner and outer spherical planes concentric with hub 14 with the inside faces being spaced from hub 14 and the retainer members being relatively orthogonally positioned and mutually spaced. Formed in the peripheral face of each head 19 are spaced rectangular positioning recesses 21 which are in diagonal registry with the corner edges of the respective shank 18.

Seven slide members 22 underly and are slidable along the spherical underfaces 20 of retainer members 19, each slide member 22 being of equilateral triangular outline and having a spherical convex outer face 23 bridging and matchingly slidably engaging a plurality of retainer member underfaces 20 and a spherical concave underface. Medially formed in each of the sides of each slide member 22 is an elongated positioning recess 24 having inwardly converging end faces 26. An elongated shank 27 of equalateral triangular transverse cross section is integrally formed with and projects outwardly from each slide member 22 and has its sides parallel to the side edges of the slide member.

An interlocking member 28 locked in between three retainer members 19 releasably interlocks slide members 22 in the cube forming positions of the face members 11. Interlocking member 28 is an integral unit including three outwardly radially directed tongues 29 mutually angularly spaced 120° and three outwardly radially directed ribs 30 interdigitating the tongues 29. Integrally formed with and projecting outwardly from the center of interlocking member 28 is a triangular shank 32 similar to shanks 27.

Each of tongues 29 includes a flat arm extending along the inside portion of interlocking member 28 and being flexible along the direction of shank 29, flexible arm 33 terminating at its free end in an inwardly projecting plug section 34 disposed immediately below spherical faces 20 and matingly releasably engagable with a slide member recess 24. Each of ribs 30 includes a longitudinally extending wing 36 whose outer free end edge is anchored with a retainer member recess 21 and is provided at its inner edge with a shoulder 37 which locks in with the underface of the respective retainer member 19. In the assembled condition or puzzle device 10 with the face elements 11 forming a cube, each of tongues 29 of the interlocking member 28 releasably engages a recess 24 of a different slide member 22, and the triangular shanks 27 and 32 project outwardly to the corner delineated by walls 38, the socket member 39 having a socket 40 of triangular transverse cross section and in mating engagement with the outer end of a respective shank 27, 32. The sockets 17 and 40 and the shanks 18, 27 and 32 are so oriented and related that in the interlocked positions of the slide members and interlocking members, the face members 11 form a cube with the shanks 27 and 32 lying along the diagonals of the cube.

Figure 10:
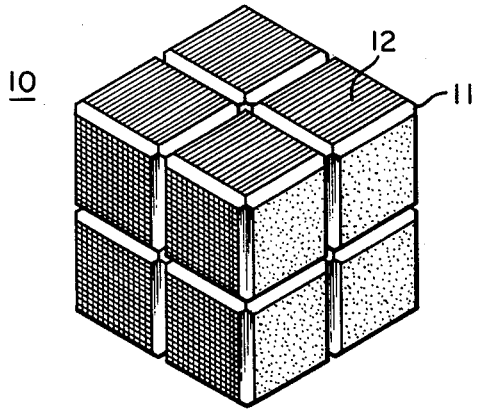
FIG. 10 is a perspective view of the puzzle device in a puzzle solved condition.

As heretofore explained, the faces 12 of each face member 11 may be of different colors, for example, red, green and yellow respectively, and the object of the puzzle is to rotate successive layers or groups of face elements 11 about the central axis perpendicular to the group, in the proper sequence, to bring the faces 12 from a randon distribution to a predetermined pattern or arrangement, for example, with the faces 12 at each face of the cube being of the same color as illustrated in FIG. 10. When a group of face members 12 is rotated from its normal position one of tongues 29 is disengaged from it's mating position with one of recesses 24 until the group is rotated 90° at which time one of the other recesses is releasably engaged by the tongue to releasably lock the face members in a cube delineating relationship.

Figure 11:
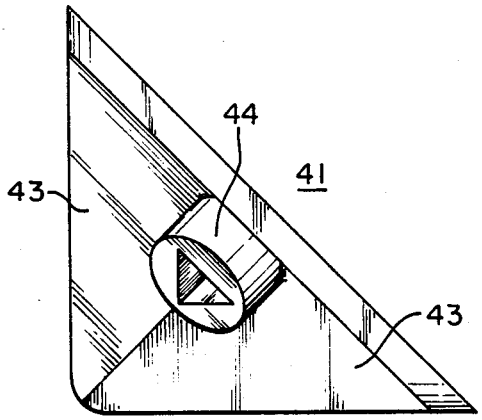
FIG. 11 is a view similar to FIG. 9 of a modified face member.
Figure 12:
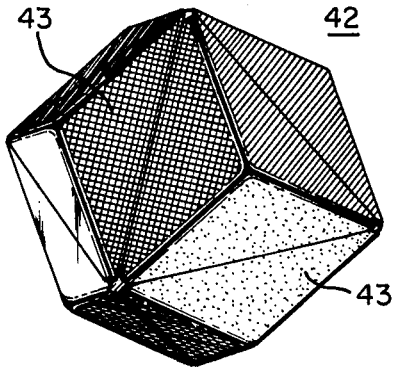
FIG. 12 is a view similar to FIG. 10 os a device with the face members of FIG. 11.

In FIGS. 11 and 12 of the drawings there is illustrated another embodiment of the present invention which differs from that described above only in the configuration of the face members 41 and the consequent shape of the assembled puzzle device 42. Specifically, each of the face members 41 includes three similar symmetrical triangular walls integrally joined along their symmetrical edges with their pieces coinciding to form a tetrahedron shape. A socket member 44 corresponding to socket member 39 projects inwardly from the apex of walls 43 and engages a corresponding slide or interlocking member shaft. In all other respects the puzzle device 42 is similar to the puzzle device 10 described earlier and the polyhedron normally formed by the face members 41 is shown in FIG. 12.

Figure 13:
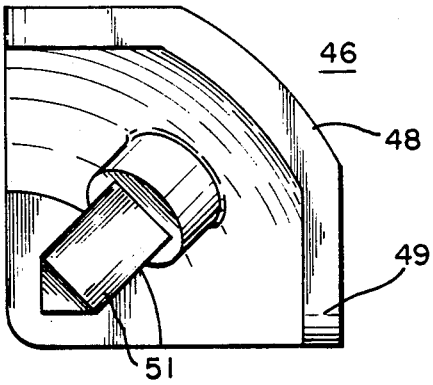
FIG. 13 is a view similar to FIG. 9 of another modified face member.
Figure 14:
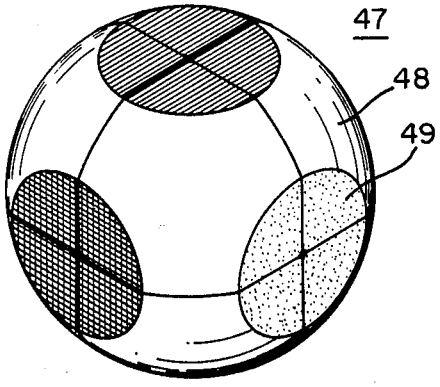
FIG. 14 is a view similar to FIG. 10 of a device with the face members of FIG. 13.

A further emobodiment of the present invention is shown in FIGS. 13 and 14 and differs from those earlier described only in the shape of the face members 46 which is normal interlocked position of the modified puzzle device provides the configuration shown in FIG. 14. The outside face 48 of face member 46 is that of that section of a sphere delineated by the outer face of the sphere and three mutually perpendicular planes intersecting at the center of the sphere, the corners of the spherical face being flattened at the corners thereof to form quadrants 49. A shank member 51 projects inwardly from the concave inside face of each face member 46 and engages a corresponding socket member (not shown) of a slide or interlocking member of the puzzle device 47 in the manner earlier described and in all other respects the device 47 is similar to the device 10 and in its normal assembled interlocked condition is of the shape of a sphere flattened at the six quadrant points thereof.

Figure 15:
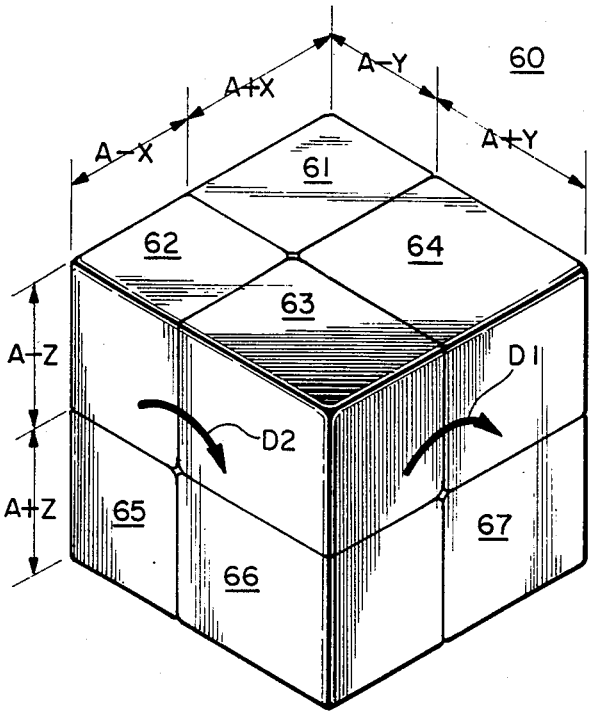
FIG. 15 is a perspective view of still another modified puzzle in puzzle solved condition.

Still another embodiment of the present invention is shown in FIGS. 15 through 18 and differs from those earlier described not only in the shape of the face members 61 through 67 (one face member is hidden from view) but in said face members size in relation to each other. While all previous embodiments included face members which were symmetrically designed. Puzzle device 60 employs face members which are assymetrical in realtion to their respective socket numbers, see FIGS. 17 and 18. The size differentials are indicated in FIG. 15. Thus just a couple of 90° turns first in the direction of D1 then D2 will result in the seemingly vastly disordered configuration shown in FIG. 16. These face members need not be color coded as they're coded by their shape and size.

Figure 17:
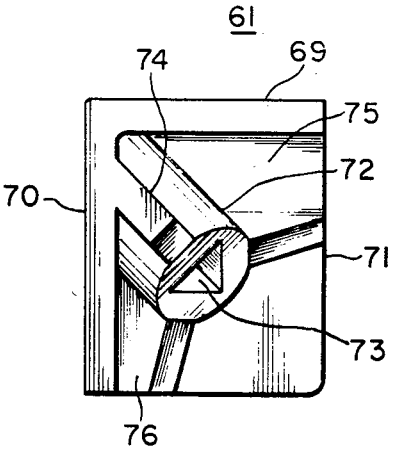
FIG. 17 is a rear elevational view of one of the face members of FIG. 15.
Figure 18:
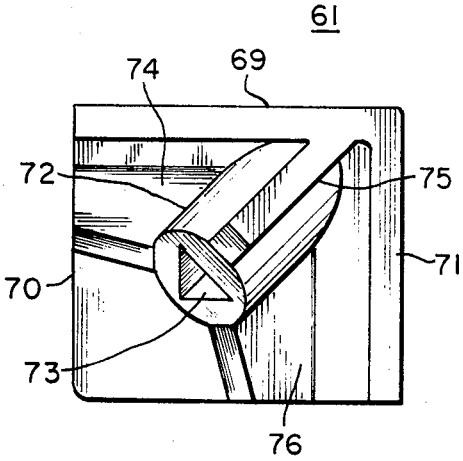
FIG. 18 is another elevational view of the same face member of FIG. 17.

Specifically, each of the face members, as typified by face member 61 shown in detail in FIGS. 17 and 18, has three orhtogonally realted rectangular side walls 69, 70 and 71 of different dimensions, the vertical edges of each face mdmber, being either A-Z or A & Z, the longitudinal edges being A-Yor A & Y and the transverse edges being A-X or A & X in dimensions, the overall dimensions of each face member being different from those of any of the other face members, as seen from FIG. 15.

Figure 16:
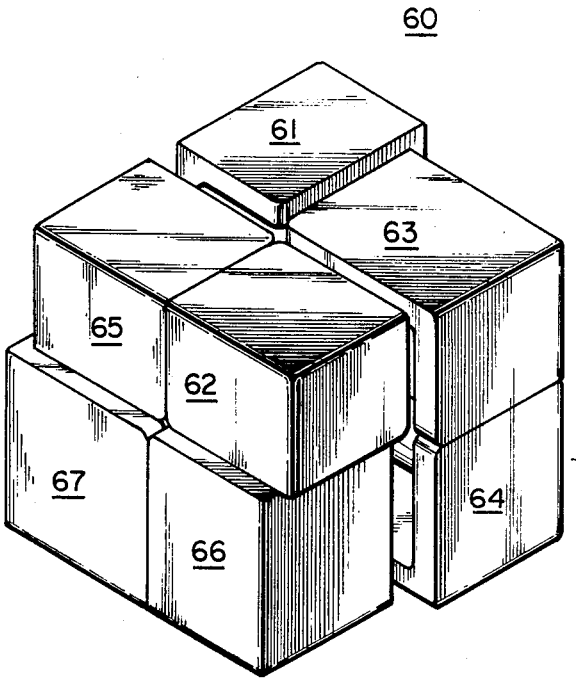
FIG. 16 is a perspective view of the same puzzle as FIG. 15 in puzzle unsolved condition.

The assembly and construction of the core member, retainer members slide members and locking members are similar to those of the earlier described embodiments but differs therefrom in that the assembly is eccentric to the center of the solved cube as shown in FIG. 16 whereas in the earlier embodiments the assembly is at the center of the solved puzzle body. Each of the face members includes a socket member 72 having a triangular axial socket 73 which is engaged by a corresponding slide or locking member shaft, the dimensions and orientation of each socket member 39 being such that in the solved condition of the cube the adjacent edges of the face members are contiguous and coexentive. Each of the socket members 72 is reinforced by integrally formed gusset plates 74,75 and 76 extending between each socket member 72 and corresponding walls of the respective face member.

Referring now to FIGS. 19 to 27 which illustrate a further embodiment of the present invention which differs from those earlier described primarily in that a plurality of outer face or shell members are mounted in the inner face members to be movable with and relative to the inner groups of face members about orthogonally related axes, the reference numeral 80 generally designates the improved puzzle device which includes an inner shell assembly 81 which, with some modifications, is similar to the device shown in FIG. 14, and an outer shell 82 surrounding the inner shell.

Figure 21:
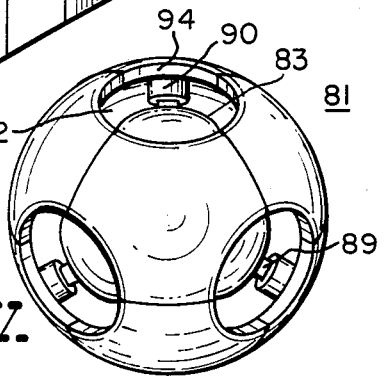
FIG. 21 is a perspective view of the device with the outer shell removed.
Figure 22:
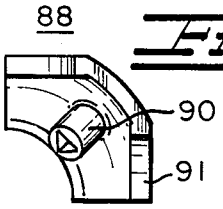
FIG. 22 is a perspective view of one of the inner shell members.
Figure 23:
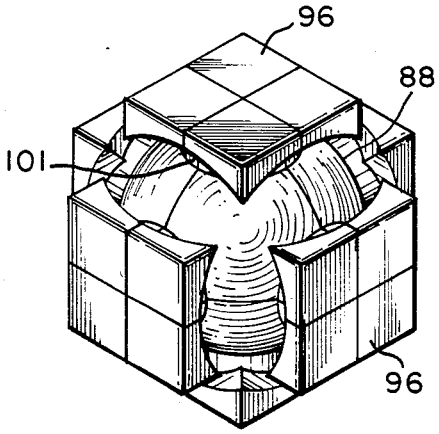
FIG. 23 is a perspective view of the partially assembled device with the corner and edge outer shell members removed.

The inner shell 81 comprises a support mechanism 83 similar to that shown in FIGS. 2 to 8 and includes a hub 84, retainer members 86, slide members 87 and an interlocking member, similar in structure and relationships to the hub 14, retaining members 19, slide members 22 and interlocking member 28 earlier described. An inner shell member 88 is supported by each of slide members 87 and the locking member by means of shanks 89 projecting radially outwardly therefrom and engaging mating socket members 90 projecting inwardly from the inside faces of inside shell members 88. Each inner shell member 88 is of the same hollow spherical configuration bounded by orthogonally related planes and has formed in each of the three corners therof a 90° arcuate recess 91 so that when the inner shell members 88 are in any end increment position as shown in FIG. 21, their outer and inner faces are concentric spheres concentric with hub 84 and the recesses 91 form six circular openings or apertures 92 coaxial with the orthogonally related axes of hub 84, each of the openings 92 having a oentinous circular border or edge 94.

Forming the outer cubic shell 82 are shell center units 96, shell edge units 97 and shell corner units 98 which, in the position shown in FIG. 80, are assembled to form a cube. There are twenty-four center units 96, four associated with each opening 92. Each center unit includes a square outer face 99 and a spherical under face 100 of greater diameter than that of inner shell 81. Depending from the underface 100 is a 90° cylindrically shaped coupling section 101 having formed in its outer lower portion an arcuate channel 102 which peripherally slidably engages an opening border 94 so that a group of four center units rotatably engages each opening 92, and pairs of adjacent center units are relatively movable with the corresponding movement of inner shell units 88.

Twenty four edge units 97 are provided, two along each edge of outer shell 82, each edge unit 97 including a pair of mutually perpendicular outside faces 103, an opposite edge spherical underface 104 and orthogonally related inner and side faces 106 and 107 respectively. Depending from underface 104 and projecting beyond inner faces 106 is a coupling section 105 which is slidably entrapped between the underfaces of center units 96 and the outer face of inner shell 81, underface 104 being in the spherical plane of the center units 96.

Figure 20:
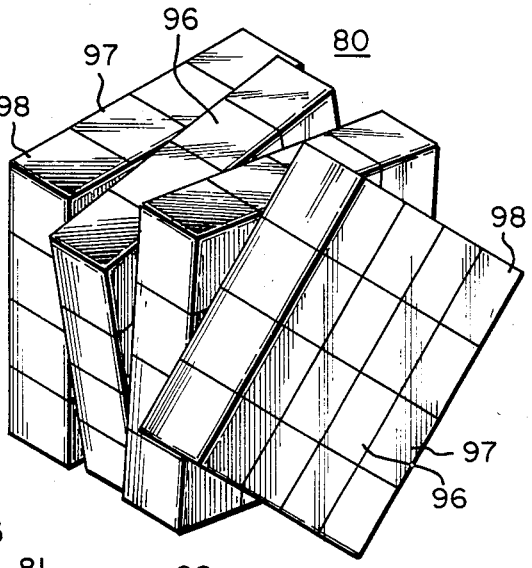
FIG. 20 is of view similar to FIG. 19 but showing the device in a condition between successive incremental positions.

Eight corner units 98 are provided, each at a corner of outer shell 82. Each corner unit 98 includes a substantially cubic body section 108 and a coupling section 109 projecting from a corner of body section 108 and having three orthogonally realted arcuate flanges 110 spaced from corresponding faces of body section 108 and and slidably entrapped between the confronting faces of units 96 and 97 and the outside face of inner shell 81. Thus, any four by four group of sixteen cube forming units is rotatable, about its central perpendicular axis, relative to the other groups, as shown in FIG. 20, such movement being permitted by reason of the rotatability of the groups of center units 96 in each opening 92.

Figure 19:
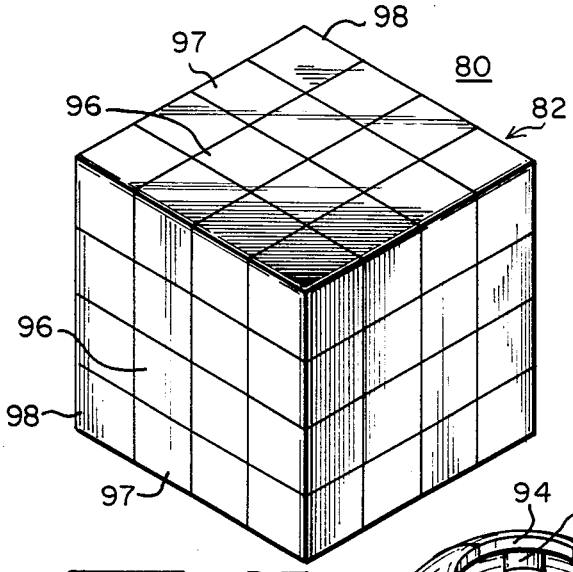
FIG. 19 is a perspective view of a further embodiment of the present invention shown in an incremental position.
Figure 24:
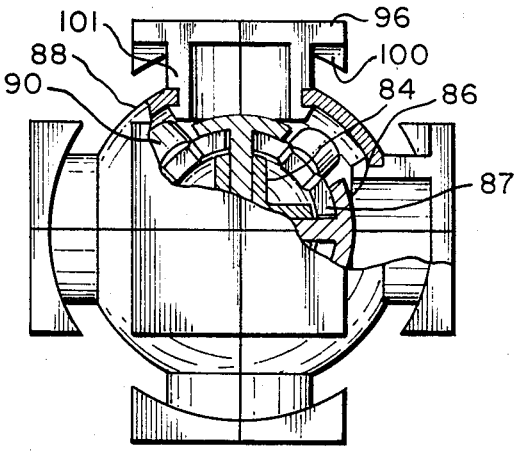
FIG. 24 is a partially fragmented front elevational view thereof.
Figure 25:
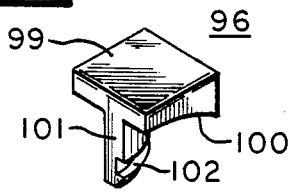
FIGS. 25 to 27 are perspective views of the central, edge and corner outer shell members which are assembled to form the device outer or face shell.
Figure 26:
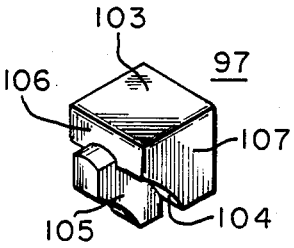
Figure 27:
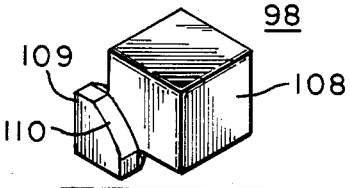

In assembling the finished device illustratdd in FIG. 19 the inner shell 81 is first assembled in the manner earlier described and as illustrated in FIG. 21 then the center units 96 are snapped into position in the openings 92 as shown in FIG. 24. Eight edge units 97 and four corner units 98 are positioned into place forming the first layer. Two edge units 97 are then disposed in each of the vertical edges and assembly is completed by then snapping the remaining four corner units 98 in place in the upper corners.

The exposed faces of each of the units 96, 97, and 98 in each of the faces of outer shell 82 are the same and are different from those in the other faces of outer shell 82. The application of the puzzle device 80 is similar to those earlier described.

While the exposed faces of the units in the various puzzle devices described above are distinguished from each other only by their color, a modified system affording alternative puzzle solutions is represented by the emobiments illustrated in FIGS. 28 to 35 of the drawings. The modified units forming the shell of the puzzle device with orientation determinitive indicia so that in the solved puzzle the units forming the shell of the puzzle device with orientation determinitive indicia so that in the solved puzzle the units are at a predetermined orientation relationship, for example, with the indicia being directed to predetermined points or targets.

Figure 28:
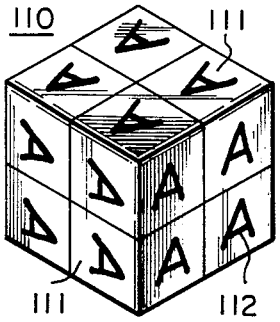
FIGS. 28 and 29 are upper front and bottom rear perspective views of another embodiment of the present invention.
Figure 29:
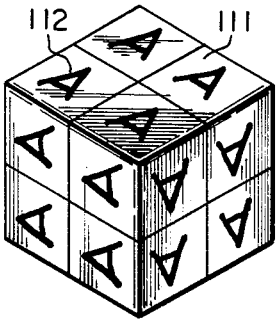
Figure 30:
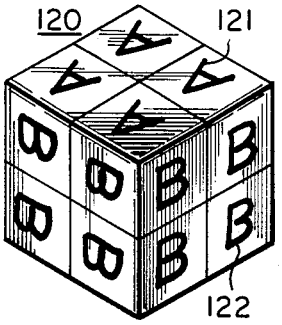
FIGS. 30 and 31 are views similar to FIGS. 28 and 29 of still another embodiment thereof.
Figure 31:
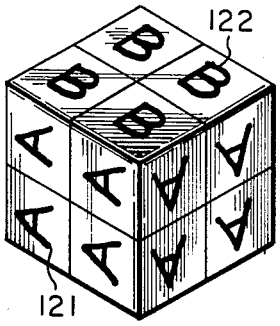

Thus in the embodiment shown in FIGS. 28 and 29 the modified puzzle device 110, constructed in the manner of the puzzle device 10 described above, is in the shape of a cube having four exposed unit faces 111 in each face of the cube 11 Carried by each face 111 is an orientation determinative indicia in the form of an assymetric letter 112, such as the letter A as shown. In one solved condition of puzzle device 110 the orientation of letters 112 along three of the cube edges converging at that corner whereas the orientation letters 112 at the other three puzzle cube faces are directed away from the edges converging to the cube opposite corner. The embodiment 120 illustrated in FIGS. 30 and 31 differs from that shown in FIGS. 28 and 29 only in that twelve of the orientation indicia 121 are one letter A and twelve indicia 122 are another letter B and in the solved condition the indicia are oriented as in the previous embodiment and as shown in the constructed drawing.

Figure 32:
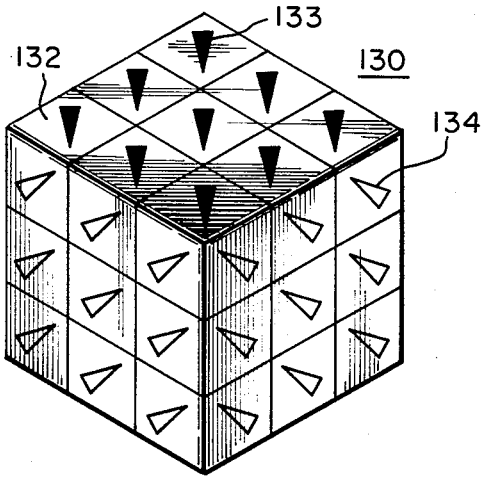
FIGS. 32 and 33 are view similar to FIGS. 28 and of a further embodiment thereof.
Figure 33:
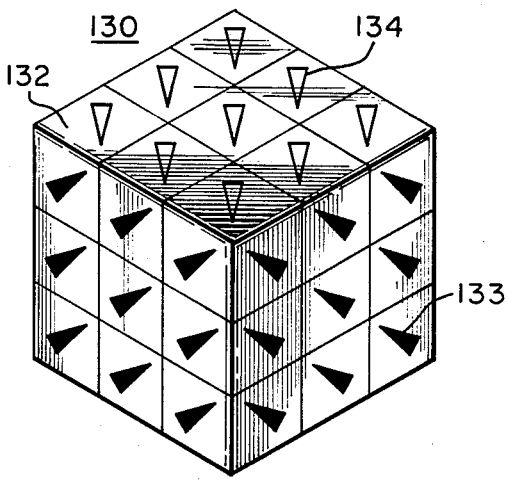

Referring to FIGS. 32 and 33 the puzzle device 130 is constructed with each side of the puzzle cube having nine exposed faces 132 arranged three by three. Twenty seven of the remaining twenty seven orientation indicia 134 are of similar shape but of a different color, each orientation triangular shape with its apex directed to a corner of a respective face 132. In a solved condition of puzzle device 130 the indicia of three cube faces are all directed to one corner of the cube and the indicia of the other faces 132 are directed to the opposite corner.

Figure 34:
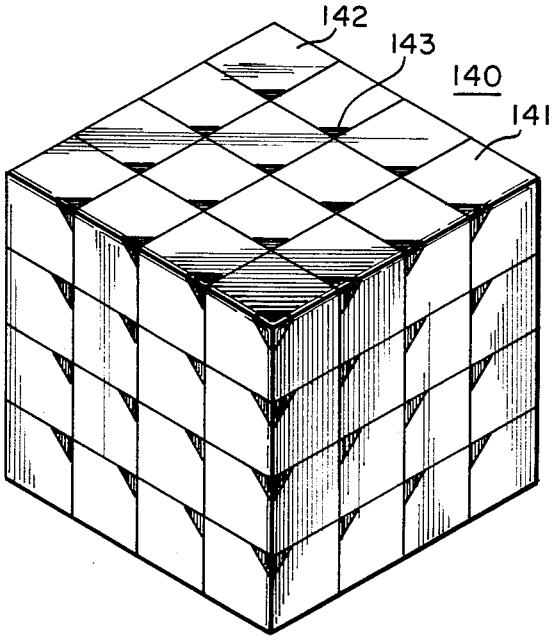
FIGS. 34 and 35 are views similar to FIGS. 28 and 29 of still a further embodiment of the present invention.
Figure 35:
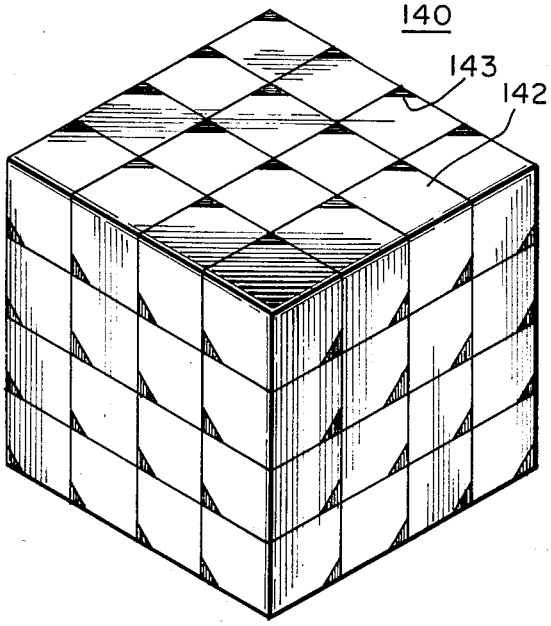

In the embodiment illustrated in FIGS. 34 and 35 the puzzle device 140 has sixteen units 141 with exposed faces 142 arranged four by four forming each face of the cubic puzzle device 140 which has the mechanical structure of the puzzle device 80 described above. One corner of each of exposed faces 142 carries an orientation determinative indicia 143 and the indicia 143 may all be of the same color or of two or more colors. A solved condition of the puzzle device 140 of three sides of the cube being located in the face corners directed toward one corner of the cube and the indicia on the remaining faces 142 being on the corners of those faces directed toward the diagonally opposite corner of the cube.

While there have been described and illustrated preferred emobodiments of the present invention it is apparent that numerous alterations, omissions and additions may be made without departing from the spirit thereof.

I claim:

1. A puzzle device, comprising eight inner shell members, first support means supporting said inner shell members for relative rotation in first groups about orthogonally related axes, a plurality of outer shell members located outwardly of and exceeding in number that of said inner shell members and second means supporting said outer shell members from said inner shell members for movement with an relative to said inner shell members for rotation in second groups about orthogonally related axes, said first support means comprising an inner core member and a plurality of mutually spaced retainer members connected to and spaced from and surrounding said core member and having inside faces lying in a spherical plane concentric with said core member and a plurality of peripherally spaced slide members underlying said retainer member inside faces and each being movable in a circular path about orthogonally related axes intersecting at the center of said spherical plane, some of said inner shell members being connected to respective ones of said slide members and disposed outwardly of said slide and retainer members, each of said inner shell members having a spherical outer face and three orthogonally related corners provided with 90 degree arcuate recesses, said shell members being relatively movable to bring groups of four of said recesses into registry to delineate six orthoganally related circular apertures, four central of said outer shell members associated with each of said circular apertures and each having a first coupling element projecting therefrom and peripherally slidably engaging the edge delineating the repective aperture, the outer edges of each of said central outer shell members having a depending outer border with an arcuate face spaced from and concentric with said inner shell members outer face to delineate orthogonally related spaced guide paths.

2. The puzzle device of claim 1 wherein said outer shell members include an edge pair thereof located between the edges of each adjacent group of central shell members, each of said edge outer shell members having a second coupling element projecting therefrom into sliding engagement with said guide paths.

3. The puzzle device of claim 2 wherein said second coupling elements have arcuate inner faces slidably engaging said inner shell outer face.

4. The puzzle device of claim 2 wherein said outer shell elements include eight outer shell corner members disposed at the corners spacing orthogonally related groups of outer shell central elements, each of said corner members having a coupling projecting therefrom into sliding engagement with orthogonally related guide paths.

* * * * *